US012181152B1

(12) United States Patent
Dai et al.

(10) Patent No.: US 12,181,152 B1
(45) Date of Patent: Dec. 31, 2024

(54) FUEL NOZZLE FOR HYDROGEN-BASED FUEL OPERATION

(71) Applicant: RTX Corporation, Farmington, CT (US)

(72) Inventors: Zhongtao Dai, West Hartford, CT (US); Justin M. Locke, Tolland, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/626,818

(22) Filed: Apr. 4, 2024

(51) Int. Cl.

| | |
|---|---|
| ***F23R 3/14*** | (2006.01) |
| ***F23R 3/36*** | (2006.01) |
| *F23R 3/00* | (2006.01) |
| *F23R 3/28* | (2006.01) |

(52) U.S. Cl.
CPC ..... *F23R 3/14* (2013.01); *F23R 3/36* (2013.01); *F23R 3/002* (2013.01); *F23R 3/286* (2013.01)

(58) Field of Classification Search
CPC .... F23R 3/14; F23R 3/28; F23R 3/283; F23R 3/286; F23R 3/346; F23R 3/36
See application file for complete search history.

(56) References Cited

U.S. PATENT DOCUMENTS

| | | | | |
|---|---|---|---|---|
| 4,139,157 | A | 2/1979 | Simmons | |
| 4,562,698 | A | 1/1986 | Halvorsen et al. | |
| 4,977,740 | A | 12/1990 | Madden et al. | |
| 5,353,599 | A * | 10/1994 | Johnson | F23M 5/085 60/39.83 |
| 10,731,861 | B2 * | 8/2020 | Schlein | F23C 7/004 |
| 11,920,525 | B2 * | 3/2024 | Snyder | F02C 7/22 |
| 11,976,820 | B2 * | 5/2024 | Snyder | F23R 3/14 |
| 12,007,116 | B2 * | 6/2024 | Morenko | F23R 3/12 |
| 2006/0248898 | A1 * | 11/2006 | Buelow | F23R 3/14 60/776 |
| 2011/0067403 | A1 * | 3/2011 | Williams | F23R 3/286 60/742 |
| 2012/0047903 | A1 * | 3/2012 | Williams | F02C 9/34 60/746 |
| 2016/0209037 | A1 * | 7/2016 | Dai | F23R 3/12 |
| 2016/0209038 | A1 * | 7/2016 | Kopp-Vaughan | F23R 3/28 |
| 2019/0257520 | A1 * | 8/2019 | Tibbs | F23R 3/14 |
| 2022/0268213 | A1 * | 8/2022 | Morenko | F23R 3/12 |
| 2024/0044293 | A1 * | 2/2024 | Snyder | F02C 9/40 |
| 2024/0044496 | A1 * | 2/2024 | Snyder | F23R 3/286 |

* cited by examiner

*Primary Examiner* — William H Rodriguez
(74) *Attorney, Agent, or Firm* — Kinney & Lange, P.A.

(57) ABSTRACT

A fuel nozzle for a gas turbine engine combustor includes a fuel nozzle assembly including an inflow tube disposed along and a nozzle axis, the inflow tube defining an inner air passage, and a liquid swirler concentrically disposed about the inflow tube, the liquid swirler including a liquid swirler inner wall, liquid swirler outer wall having a liquid swirler outer wall end portion angled radially inward toward the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis such that it is parallel to the liquid swirler outer wall end portion, an RAS outer wall having an end cap at a downstream-most position, and an annular gas passage defined therebetween. The end cap includes a radiused inner surface and an outer surface.

20 Claims, 6 Drawing Sheets

FUEL NOZZLE FOR HYDROGEN-BASED FUEL OPERATION

STATEMENT OF GOVERNMENT INTEREST

This invention was made with government support under Contract No. DE-FE0032171 awarded by United States Department of Energy. The government has certain rights in the invention.

BACKGROUND

The present disclosure relates to a gas turbine engine and, more particularly, to fuel nozzle passages for both a liquid and a gas.

Gas turbine engines, such as Industrial Gas Turbines utilized in power production, mechanical drives, and aero engines in commercial and military aircraft, include a compressor section to pressurize airflow, a combustor section to burn a hydrocarbon fuel in the presence of the pressurized air, and a turbine section to extract energy from the resultant combustion gases.

The combustor section includes multiple circumferentially distributed fuel nozzles that project into a forward section of a combustion chamber to supply fuel to mix with the pressurized airflow. The fuel nozzles may simultaneously utilize different types and combinations of fuel such as hydrogen, natural gas, Jet-A, diesel, JP8, and others. Further, to facilitate lower NOx emissions, water may be injected though the nozzle as well. Current fuel nozzle designs may, however, have durability issues due to potential flame holding and/or periodic flashback when hydrogen-based fuels are used. Accordingly, means for improving fuel nozzle cooling and mitigating flame holding and/or flashback are desirable.

SUMMARY

A fuel nozzle for a gas turbine engine combustor includes a fuel nozzle assembly including an inflow tube disposed along and a nozzle axis, the inflow tube defining an inner air passage, and a liquid swirler concentrically disposed about the inflow tube, the liquid swirler including a liquid swirler inner wall, liquid swirler outer wall having a liquid swirler outer wall end portion angled radially inward toward the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis such that it is parallel to the liquid swirler outer wall end portion, an RAS outer wall having an end cap at a downstream-most position, and an annular gas passage defined therebetween. The end cap includes a radiused inner surface and an outer surface.

A gas turbine engine includes a combustor having a plurality of circumferentially distributed fuel nozzles, each of the plurality of fuel nozzles including a fuel nozzle assembly including an inflow tube disposed along and a nozzle axis, the inflow tube defining an inner air passage, and a liquid swirler concentrically disposed about the inflow tube, the liquid swirler including a liquid swirler inner wall, liquid swirler outer wall having a liquid swirler outer wall end portion angled radially inward toward the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis such that it is parallel to the liquid swirler outer wall end portion, an RAS outer wall having an end cap at a downstream-most position, and an annular gas passage defined therebetween. The end cap includes a radiused inner surface and an outer surface.

Figure 1:
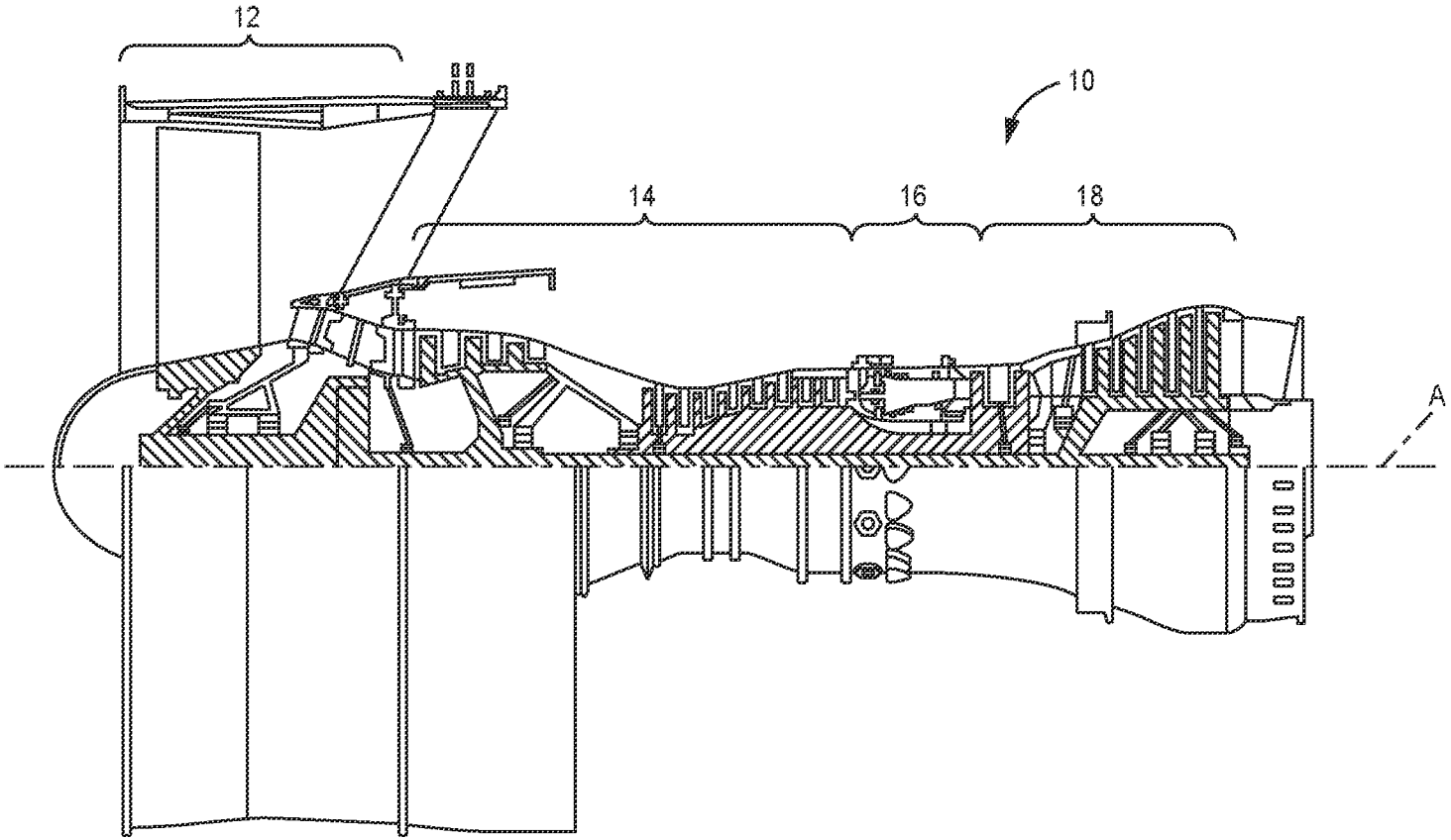
FIG. 1 is a simplified cross-sectional illustration of one example of a gas turbine engine.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

Figure 2:
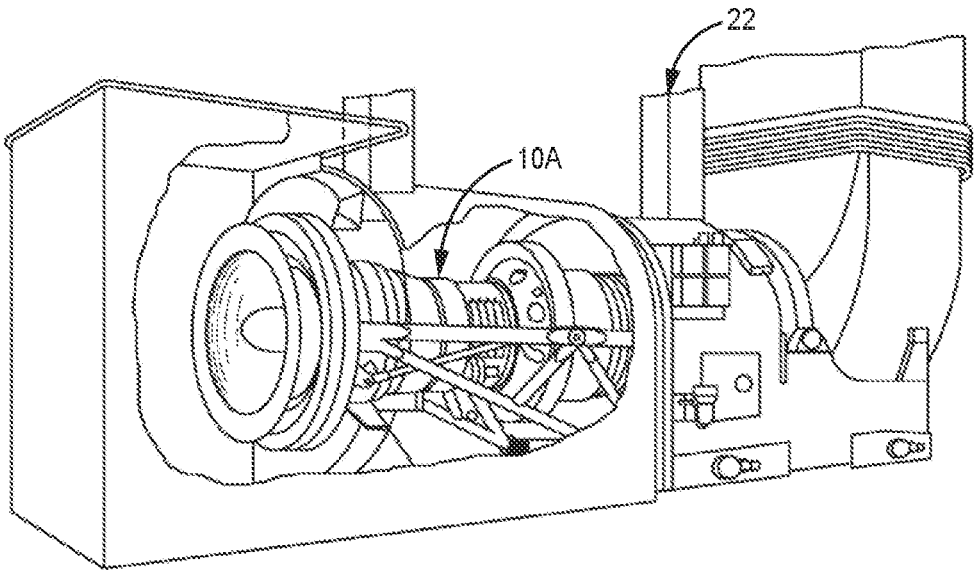
FIG. 2 is a simplified breakaway illustration of a second example of a gas turbine engine.

FIG. 1 schematically illustrates gas turbine engine 10. Gas turbine engine 10 is disclosed herein as a two-spool turbo fan that generally includes fan section 12, compressor section 14, combustor section 16 and turbine section 18. Fan section 12 drives air along a bypass flow path and into compressor section 14. Compressor section 14 drives air along a core flow path for compression and communication into combustor section 16, which then expands and directs the air through turbine section 18. Although depicted as a turbofan in the disclosed non-limiting embodiment, it should be understood that the concepts described herein are not limited to use with turbofans as the teachings may be applied to other types of turbine engines such as a low bypass augmented turbofan, turbojets, turboshafts, and three-spool (plus fan) turbofans with an intermediate spool. Still another engine architecture 10A can be located within enclosure 22 (FIG. 2) typical of an industrial gas turbine (IGT) in which there is no fan section, and hot gases that exit the low-pressure turbine flow into a power turbine to extract work.

Figure 3:
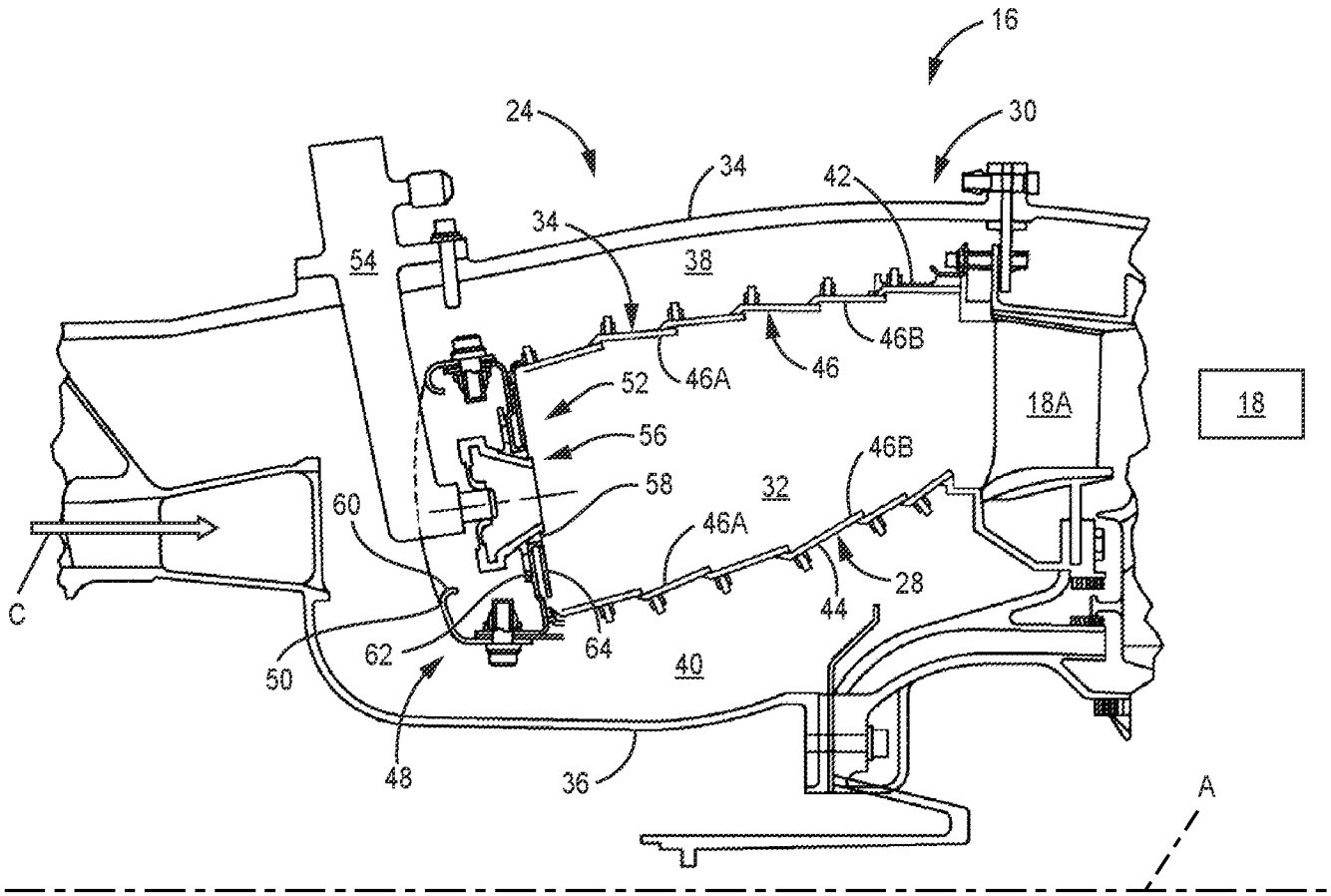
FIG. 3 is a simplified cross-sectional illustration of a combustor section of a gas turbine engine.

FIG. 3 schematically illustrates combustor section 16 (i.e., of gas turbine engines 10 and/or 10A). Combustor section 16 can include a combustor 24 with outer combustor wall assembly 26, inner combustor liner assembly 28 and diffuser case module 30. Outer combustor liner assembly 26 and inner combustor liner assembly 28 are spaced apart such that combustion chamber 32 is defined therebetween. Combustion chamber 32 may be generally annular in shape. Other combustors may include a number of individual cans.

Outer combustor liner assembly 26 is spaced radially inward from outer diffuser case 34 of diffuser case module 30 to define outer annular plenum 38. Inner combustor liner assembly 28 is spaced radially outward from inner diffuser case 36 of diffuser case module 30 to define inner annular plenum 40. It should be understood that although a particular combustor is illustrated, other combustor types with various combustor liner arrangements will also benefit herefrom. It should be further understood that the disclosed cooling flow paths are but an illustrated embodiment and should not be limited only thereto.

Combustor liner assemblies 26, 28 contain combustion products for direction toward turbine section 18. Each combustor liner assembly 26, 28 generally includes a respective support shell 42, 44 which supports one or more liner panels 46 mounted to a hot side of the respective support shell 42, 44. Each liner panel 46 may be generally rectilinear and manufactured of, for example, a nickel based super alloy, ceramic or other temperature resistant material and are arranged to form a liner array. In one disclosed non-limiting embodiment, the liner array includes a multiple of forward liner panels 46A and a multiple of aft liner panels 46B that are circumferentially staggered to line the hot side of outer shell 42. A multiple of forward liner panels 46A and a multiple of aft liner panels 46B are circumferentially staggered to line hot side of inner shell 44.

Combustor 24 further includes forward assembly 48 immediately downstream of compressor section 14 to receive compressed airflow therefrom. Forward assembly 48 generally includes annular hood 50 and bulkhead assembly 52 which locate a multiple of fuel nozzles 54 (one shown) and a multiple of guide swirlers 56 (one shown). Each guide swirler 56 is mounted within a respective opening 58 of bulkhead assembly 52 to be circumferentially aligned with one of a multiple of annular hood ports 60. Each bulkhead assembly 52 generally includes bulkhead support shell 62 secured to combustor liner assemblies 26, 28, and a multiple of circumferentially distributed bulkhead liner panels 64 secured to bulkhead support shell 62.

Annular hood 50 extends radially between, and is secured to, the forwardmost ends of combustor liner assemblies 26, 28. Annular hood 50 forms the multiple of circumferentially distributed hood ports 60 that accommodate a respective fuel nozzle 54 and introduce air into the forward end of combustion chamber 32. Each fuel nozzle 54 may be secured the diffuser case module 30 and project through one of the hood ports 60 and the respective guide swirler 56.

Forward assembly 48 introduces core combustion air into the forward section of combustion chamber 32 while the remainder enters outer annular plenum 38 and inner annular plenum 40. The multiple of fuel nozzles 54 and adjacent structure generate a blended fuel-air mixture that supports stable combustion in combustion chamber 32. Opposite forward assembly 48, outer and inner support shells 42, 44 are mounted to a first row of Nozzle Guide Vanes (NGVs) 18A. NGVs 18A are static engine components which direct the combustion gases onto the turbine blades in turbine section 18 to facilitate the conversion of pressure energy into kinetic energy. The combustion gases are also accelerated by the NGVs 18A because of their convergent shape and are typically given a "spin" or a "swirl" in the direction of turbine rotation.

Figure 4:
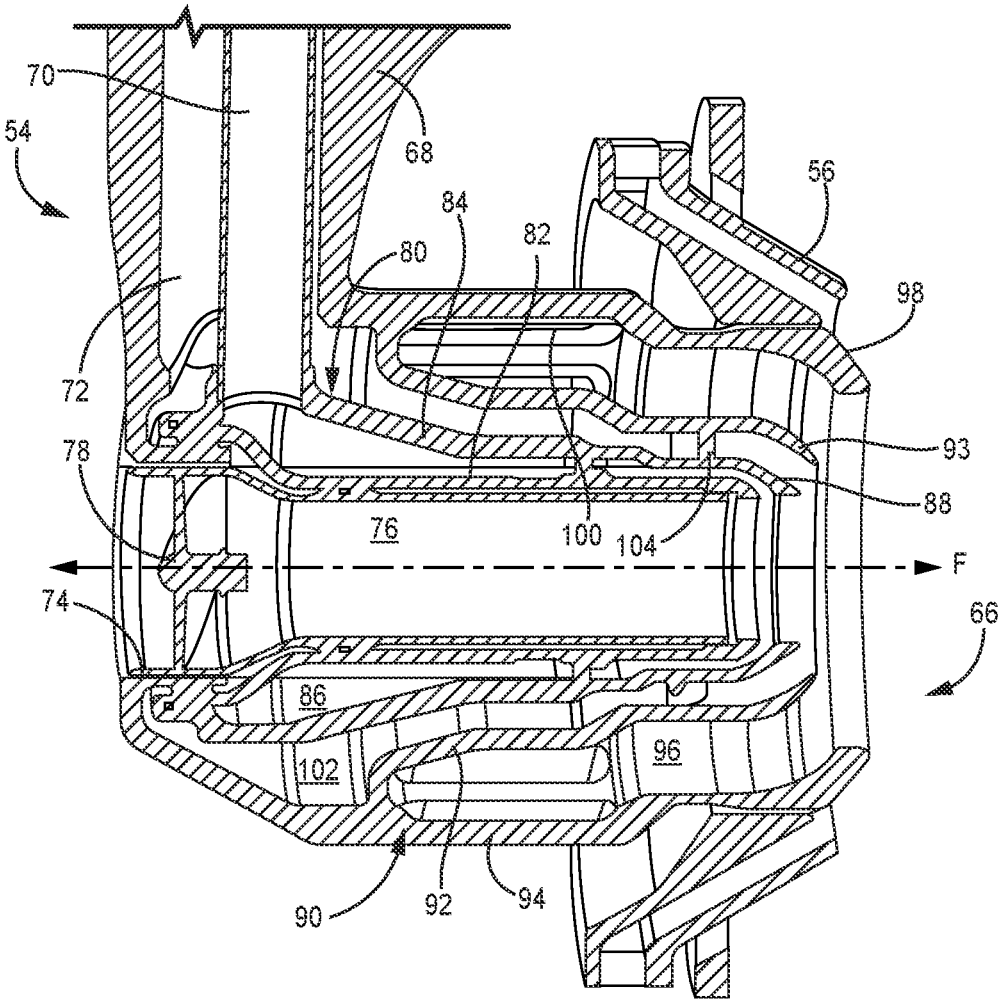
FIG. 4 is a simplified cross-sectional illustration of a portion of a fuel injector for a gas turbine engine combustor section.

FIG. 4 is a schematic cross-sectional illustration of a portion of fuel injector 54 including fuel nozzle assembly 66. Fuel injector 54 includes fluid passages within support housing 68 which are in fluid communication with fuel nozzle assembly 66 as is discussed in greater detail below. More specifically, tube 70 is configured to provide a liquid (e.g., liquid fuel or water) to fuel nozzle assembly 66, and gas passage 72 is configured to supply a gaseous fuel, or "fuel gas" (e.g., hydrogen and/or natural gas) to fuel nozzle assembly 66. Gas passage 72 can function as a heat shield to prevent coking when the fuel used is a liquid fuel. In one example, the fuel gas can be hydrogen based, such as pure hydrogen or a blend of hydrogen with a gaseous hydrocarbon, such as natural gas or propane. In such example, water can be the liquid injected via tube 70 to help reduce NOx emissions. Fuel nozzle assembly 66 can be partially received by guide swirler 56.

Fuel nozzle assembly 66 generally extends along and is disposed about nozzle axis F. Beginning radially inward, inflow tube 74 defines inner gas passage 76 of fuel nozzle assembly 66. Axial swirler 78 with helical vanes is disposed within inner gas passage 76 to swirl incoming air. Liquid swirler 80 is concentrically disposed about inflow tube 74 and includes inner wall 82 and outer wall 84, and annular liquid passage 86 defined therebetween. Annular liquid passage 86 receives liquid from tube 70. End portion 88 of outer wall 84 can be angled toward axis F to direct the flow of liquid radially inward. Radial air swirler 90 is concentrically disposed about liquid swirler 80 and includes inner wall 92, outer wall 94, and annular air passage 96 defined therebetween. Inner wall 92 includes end portion 93 which is angled toward axis F. Outer wall 94 includes end cap 98 which can be similarly angled toward axis F such that end portion 93 and end cap 98 help direct the flow of air exiting annular air passage 96 radially inward. Air enters annular air passage 96 via slots 100 within outer wall 94. Annular fuel gas passage 102 is defined between outer wall 84 of liquid swirler 80 and inner wall 92 of radial air swirler 90. Annular fuel gas passage 102 receives fuel gas from gas passage 72. Fuel swirlers 104 can be disposed within fuel gas passage 102 to swirl the flow of fuel gas.

Figure 5A:
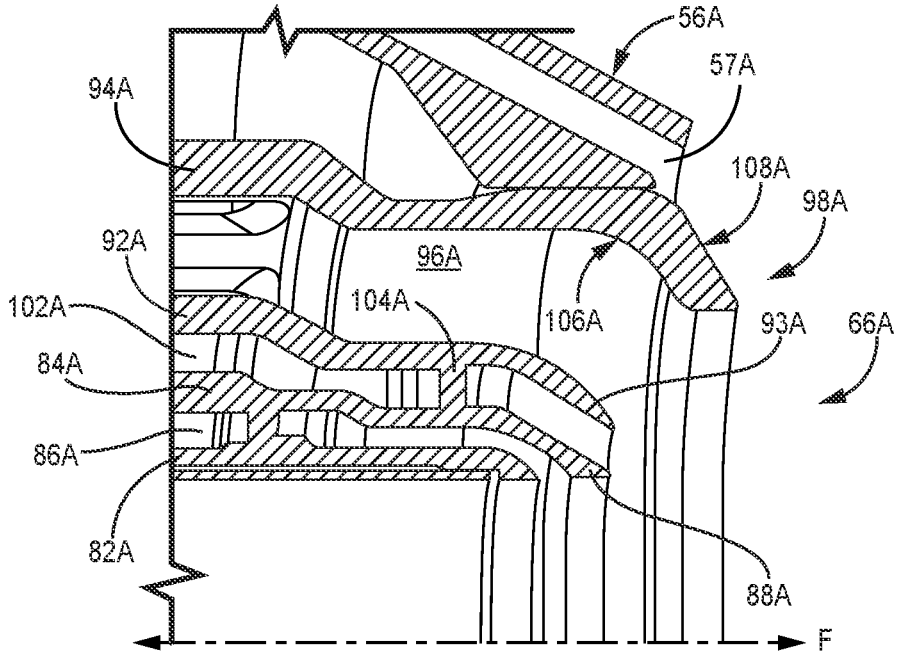
FIG. 5A is an enlarged cross-sectional view of a portion of a first fuel nozzle assembly.
Figure 5B:
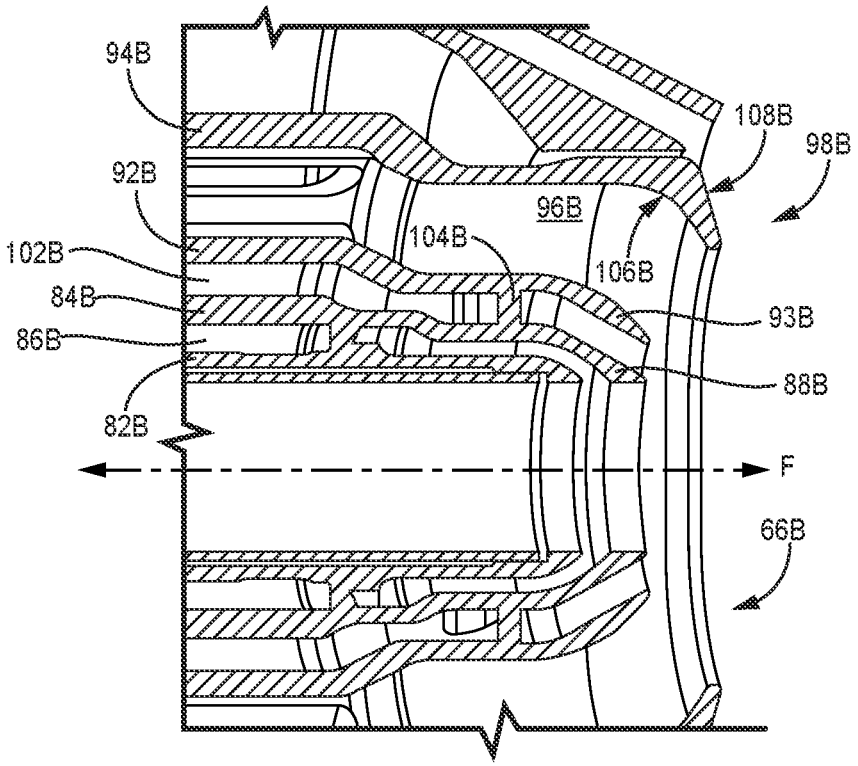
FIG. 5B is an enlarged cross-sectional view of a portion of an alternative fuel nozzle assembly.

FIGS. 5A and 5B are enlarged cross-sectional views of portions of alternative fuel nozzle assemblies 66A and 66B. FIGS. 5A and 5B are discussed with continued reference to FIG. 4.

Referring first to FIG. 5A, fuel nozzle assembly 66A is substantially similar to fuel nozzle assembly 66 as shown in FIG. 4. As shown, fuel swirlers 104A are recessed, which in the embodiment shown, means that fuel swirlers 104A are positioned upstream of end portions 88A and 93A of outer wall 84A and inner wall 92A, respectively. Further, end portions 88A and 93A are both similarly radiused and angled inward toward axis F such that each is parallel to the other. Existing fuel nozzle assembly designs can be prone to "flame holding" because the low velocity region of the fuel swirler trailing edges meets with the air flow through the radial air swirler and may contain a fuel-air mixture. The recessed nature of fuel swirlers 104A shifts the respective trailing edges sufficiently upstream to prevent meeting with radial air swirler flows and therefore helps to prevent flame holding on fuel swirlers 104A. Additionally, the inwardly angled downstream portion of annular fuel gas passage 102A created by end portions 88A and 93A directs the exiting fuel gas flow away from end cap 98A, another structure against which flame holding is common in existing designs. This is facilitated by the similarly angled air flow exiting annular gas passage 96A. The elbow-shaped radius of end portion 93A is increased sufficiently over existing designs to improve the turning of the air flow through annular gas passage 96A and kill flame holding potential. The end tips of 88A and 93A are sufficiently sharp to kill flame holding potential. The angled nature of end portions 88A and 93A further brings exiting fuel gas closer to liquid exiting annular liquid passage 86A than existing designs which improves atomization of the liquid. Finally, end cap 98A of outer wall 94A can include radiused inner surface 106A and contoured outer surface 108A. Radiused inner surface 106A permits higher flow velocity of air flow exiting annular gas passage 96A, relative to sharp-corner geometries, to provide additional cooling to end cap 98A. Contoured outer surface 108A is generally aligned with annular air passage 57A of guide swirler 56A which eliminates a flow separation zone that may be present in existing designs and cause end cap flame holding.

Referring to FIG. 5B, fuel nozzle assembly 66B is substantially similar to fuel nozzle assembly 66A, having recessed fuel swirlers 104B in annular fuel gas passage 102A relative to end portions 88B and 93B of outer wall 84B and inner wall 92B, respectively. This imparts all the benefits noted above with respect to fuel nozzle assembly 66A, including improved atomization of water or liquid fuel exiting annular liquid passage 86B. End cap 98B of outer wall 94B has a radiused inner surface 106B and outer surface 108B. Like end cap 94A, radiused inner surface 106B can provide cooling by allowing for increased flow velocity through annular air passage 96B.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

DISCUSSION OF POSSIBLE EMBODIMENTS

The following are non-exclusive descriptions of possible embodiments of the present invention.

A fuel nozzle for a gas turbine engine combustor includes a fuel nozzle assembly including an inflow tube disposed along and a nozzle axis, the inflow tube defining an inner air passage, and a liquid swirler concentrically disposed about the inflow tube, the liquid swirler including a liquid swirler inner wall, liquid swirler outer wall having a liquid swirler outer wall end portion angled radially inward toward the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis such that it is parallel to the liquid swirler outer wall end portion, an RAS outer wall having an end cap at a downstream-most position, and an annular gas passage defined therebetween. The end cap includes a radiused inner surface and an outer surface.

The fuel nozzle of the preceding paragraph can optionally include, additionally and/or alternatively, any one or more of the following features, configurations and/or additional components:

The above fuel nozzle can further include a guide swirler disposed concentrically about the RAS outer wall, the guide swirler comprising an annular air passage angled radially inward toward the nozzle axis.

In any of the above fuel nozzles, the outer surface of the end cap can be contoured such that it is aligned with the annular air passage of the guide swirler.

In any of the above fuel nozzles, the liquid swirler outer wall and the RAS inner wall can define an annular fuel gas passage therebetween.

Any of the above fuel nozzles can further include a plurality of fuel swirlers disposed within the annular fuel gas passage upstream of each of the liquid swirler outer wall end portion and the RAS inner wall end portion.

In any of the above fuel nozzles, the fuel gas can include one or a combination of hydrogen, propane, and natural gas.

Any of the above fuel nozzles can further include an axial swirler disposed within the inner gas passage.

In any of the above fuel nozzles, a plurality of slots can extend through the RAS outer wall for allowing air to pass therethrough into the annular gas passage.

Any of the above fuel nozzles can further include a tube extending through a housing of the fuel nozzle, the tube being in fluid communication with the annular liquid passage.

Any of the above fuel nozzles can further include a gas passage extending through a housing of the fuel nozzle, the gas passage being in fluid communication with the annular fuel gas passage.

A gas turbine engine includes a combustor having a plurality of circumferentially distributed fuel nozzles, each of the plurality of fuel nozzles including a fuel nozzle assembly including an inflow tube disposed along and a nozzle axis, the inflow tube defining an inner air passage, and a liquid swirler concentrically disposed about the inflow tube, the liquid swirler including a liquid swirler inner wall, liquid swirler outer wall having a liquid swirler outer wall end portion angled radially inward toward the nozzle axis, and an annular liquid passage defined therebetween. The fuel nozzle assembly further includes a radial air swirler (RAS) concentrically disposed about the liquid swirler outer wall, the RAS including an RAS inner wall having an RAS inner wall end portion angled radially inward toward the nozzle axis such that it is parallel to the liquid swirler outer wall end portion, an RAS outer wall having an end cap at a downstream-most position, and an annular gas passage defined therebetween. The end cap includes a radiused inner surface and an outer surface.

The gas turbine engine of the preceding paragraph can optionally include, additionally and/or alternatively, any one or more of the following features, configurations and/or additional components:

The above gas turbine engine can further include a guide swirler disposed concentrically about the RAS outer wall, the guide swirler comprising an annular air passage angled radially inward toward the nozzle axis.

In any of the above gas turbine engines, the outer surface of the end cap can be contoured such that it is aligned with the annular air passage of the guide swirler.

In any of the above gas turbine engines, the liquid swirler outer wall and the RAS inner wall can define an annular fuel gas passage therebetween.

Any of the above gas turbine engines can further include a plurality of fuel swirlers disposed within the annular fuel gas passage upstream of each of the liquid swirler outer wall end portion and the RAS inner wall end portion.

In any of the above gas turbine engines, the fuel gas can include one or a combination of hydrogen, propane, and natural gas.

Any of the above gas turbine engines can further include an axial swirler disposed within the inner gas passage.

In any of the above gas turbine engines, a plurality of slots can extend through the RAS outer wall for allowing air to pass therethrough into the annular gas passage.

Any of the above gas turbine engines can further include a tube extending through a housing of the fuel nozzle, the tube being in fluid communication with the annular liquid passage.

Any of the above gas turbine engines can further include a gas passage extending through a housing of the fuel nozzle, the gas passage being in fluid communication with the annular fuel gas passage.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fuel nozzle for a gas turbine engine combustor, the fuel nozzle comprising:
- a fuel nozzle assembly comprising:
  - an inflow tube disposed along and a nozzle axis, the inflow tube defining an inner air passage;
  - a liquid swirler concentrically disposed about the inflow tube, the liquid swirler comprising:
    - a liquid swirler inner wall;
    - liquid swirler outer wall having a liquid swirler outer wall end portion angled radially inward toward the nozzle axis; and
    - an annular liquid passage defined therebetween; and
  - a radial air swirler (RAS) concentrically disposed about the liquid swirler outer wall, the RAS comprising:
    - an RAS inner wall having an RAS inner wall end portion angled radially inward toward the nozzle axis such that it is parallel to the liquid swirler outer wall end portion;
    - an RAS outer wall having an end cap at a downstream-most position; and
    - an annular gas passage defined therebetween,
    - wherein the end cap comprises a radiused inner surface and an outer surface.

2. The fuel nozzle of claim 1 and further comprising: a guide swirler disposed concentrically about the RAS outer wall, the guide swirler comprising an annular air passage angled radially inward toward the nozzle axis.

3. The fuel nozzle of claim 2, wherein the outer surface of the end cap is contoured such that it is aligned with the annular air passage of the guide swirler.

4. The fuel nozzle of claim 2, wherein the liquid swirler outer wall and the RAS inner wall define an annular fuel gas passage therebetween.

5. The fuel nozzle of claim 4 and further comprising: a plurality of fuel swirlers disposed within the annular fuel gas passage upstream of each of the liquid swirler outer wall end portion and the RAS inner wall end portion.

6. The fuel nozzle of claim 4, wherein the fuel gas comprises one or a combination of hydrogen, propane, and natural gas.

7. The fuel nozzle of claim 2 and further comprising: an axial swirler disposed within the inner gas passage.

8. The fuel nozzle of claim 2, wherein a plurality of slots extend through the RAS outer wall for allowing air to pass therethrough into the annular gas passage.

9. The fuel nozzle of claim 2 and further comprising: a tube extending through a housing of the fuel nozzle, the tube being in fluid communication with the annular liquid passage.

10. The fuel nozzle of claim 2 and further comprising: a gas passage extending through a housing of the fuel nozzle, the gas passage being in fluid communication with the annular fuel gas passage.

11. A gas turbine engine comprising:
- a combustor having a plurality of circumferentially distributed fuel nozzles, each of the plurality of fuel nozzles comprising:
  - a fuel nozzle assembly comprising:
    - an inflow tube disposed along and a nozzle axis, the inflow tube defining an inner air passage;
    - a liquid swirler concentrically disposed about the inflow tube, the liquid swirler comprising:
      - a liquid swirler inner wall;
      - a liquid swirler outer wall having a liquid swirler outer wall end portion angled radially inward toward the nozzle axis; and
      - an annular liquid passage defined therebetween; and
    - a radial air swirler (RAS) concentrically disposed about the liquid swirler outer wall, the RAS comprising:
      - an RAS inner wall having an RAS inner wall end portion angled radially inward toward the nozzle axis such that it is parallel to the liquid swirler outer wall end portion;
      - an RAS outer wall having an end cap at a downstream-most position; and
      - an annular gas passage defined therebetween,
      - wherein the end cap comprises a radiused inner surface and an outer surface.

12. The gas turbine engine of claim 11 and further comprising: a guide swirler disposed concentrically about the RAS outer wall, the guide swirler comprising an annular air passage angled radially inward toward the nozzle axis.

13. The gas turbine engine of claim 12, wherein the outer surface of the end cap is contoured such that it is aligned with the annular air passage of the guide swirler.

14. The gas turbine engine of claim 12, wherein the liquid swirler outer wall and the RAS inner wall define an annular fuel gas passage therebetween.

15. The gas turbine engine of claim 14 and further comprising: a plurality of fuel swirlers disposed within the annular fuel gas passage upstream of each of the liquid swirler outer wall end portion and the RAS inner wall end portion.

16. The gas turbine engine of claim 14, wherein the fuel gas comprises one or a combination of hydrogen, propane, and natural gas.

17. The gas turbine engine of claim 12 and further comprising: an axial swirler disposed within the inner gas passage.

18. The gas turbine engine of claim 12, wherein a plurality of slots extend through the RAS outer wall for allowing air to pass therethrough into the annular gas passage.

19. The gas turbine engine of claim 12 and further comprising: a tube extending through a housing of the fuel nozzle, the tube being in fluid communication with the annular liquid passage.

20. The gas turbine engine of claim 12 and further comprising: a gas passage extending through a housing of the fuel nozzle, the gas passage being in fluid communication with the annular fuel gas passage.

* * * * *